US005514027A

United States Patent [19]

Pearlman

[11] Patent Number: 5,514,027

[45] Date of Patent: May 7, 1996

[54] SANDING HEAD FOR A SANDING MACHINE

[75] Inventor: Gordon Pearlman, Los Angeles, Calif.

[73] Assignee: Pearl Abrasive Co., Commerce, Calif.

[21] Appl. No.: 231,104

[22] Filed: Apr. 22, 1994

[51] Int. Cl.[6] ..... B24B 23/00

[52] U.S. Cl. ..... 451/353; 451/350; 125/38

[58] Field of Search ..... 51/177, 174, 170 T, 51/209 R, 209 S, 266; 125/38, 25

[56] References Cited

U.S. PATENT DOCUMENTS

| | | | |
|---|---|---|---|
| 922,382 | 5/1909 | Brenizer | 51/209 R |
| 1,176,262 | 3/1916 | Zoboli et al. | 51/209 R |
| 1,770,549 | 7/1930 | Peterson . | |
| 1,932,319 | 10/1933 | Myers | 51/177 |
| 2,264,177 | 11/1941 | Harrington | 51/209 |
| 2,578,588 | 12/1951 | Pascotto | 51/177 |
| 2,769,626 | 11/1956 | Becker . | |
| 3,146,559 | 9/1964 | Wilkinson | 51/174 |
| 3,464,166 | 9/1969 | Bouvier | 51/209 |
| 3,522,679 | 8/1970 | Sundberg | 51/177 |
| 3,580,638 | 5/1971 | Pullen | 299/25 |
| 3,701,221 | 10/1972 | Vinella . | |
| 3,934,377 | 1/1976 | Tertinek | 51/177 |
| 4,461,268 | 7/1984 | Inoue | 125/15 |
| 4,624,237 | 11/1986 | Inoue | 125/15 |
| 4,668,017 | 5/1987 | Peterson et al. | 299/37 |
| 4,758,050 | 7/1988 | Peterson et al. | 299/39 |
| 4,939,872 | 7/1990 | Revelin et al. | 51/180 |

FOREIGN PATENT DOCUMENTS

| | | | |
|---|---|---|---|
| 697572 | 6/1930 | France . | |
| 7184664 | 11/1982 | Japan | 451/359 |

*Primary Examiner*—Robert A. Rose

*Attorney, Agent, or Firm*—Pretty, Schroeder, Brueggemann & Clark

[57] ABSTRACT

A sanding head for a rotary sanding machine. The sanding head includes a rotatable disk and a plurality of abraders. The disk has a bottom surface and an outer circumferential edge. The bottom surface of the disk has uniformly distributed topographical variations that extend radially inwardly from the outer edge of the disk. A plurality of conformly distributed abraders project from the bottom surface of the disk to contact the surface to be sanded.

18 Claims, 2 Drawing Sheets

FIG. 1
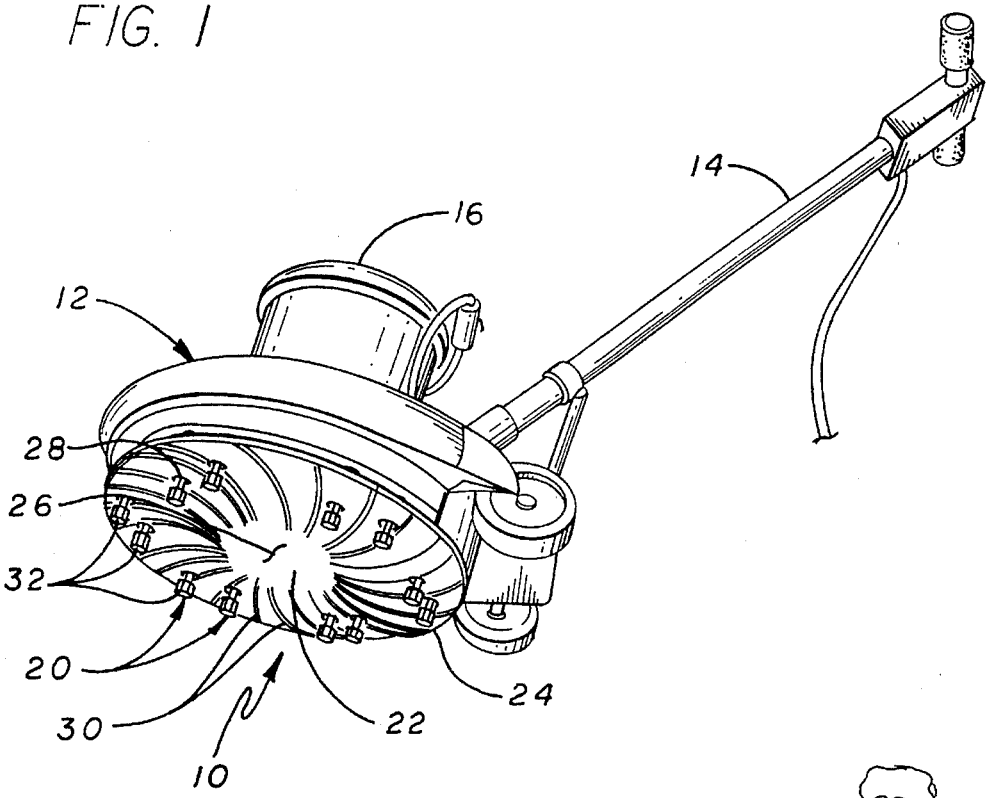
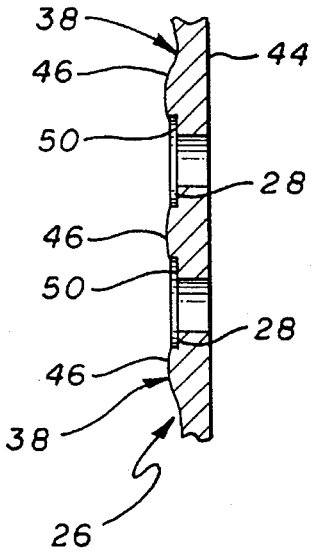
FIG. 6
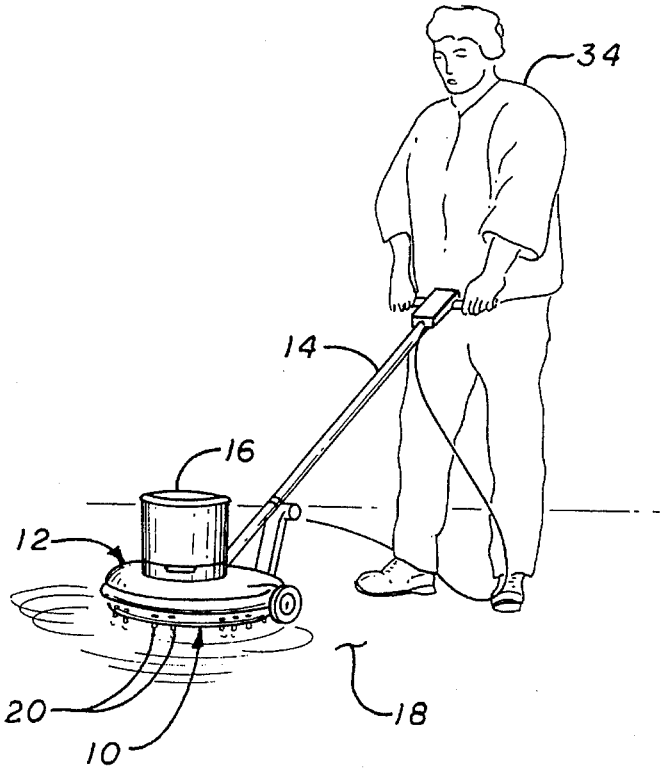
FIG. 2

SANDING HEAD FOR A SANDING MACHINE

FIELD OF THE INVENTION

This invention relates generally to abrading tools and, more particularly, to an improved sanding head for a sanding machine.

BACKGROUND OF THE INVENTION

Machines for sanding and grinding relatively hard surfaces, such as concrete floors, are well known in the prior art. Such machines can employ a rotating disk or an otherwise moving head element that has protruding pins with abrasive heads. As the disk is rotated, the abrasive pin heads grind numerous dust particles from the surface. The pins are spring biased so that they can move to maintain contact with uneven surfaces.

The sanding machines designed according to the prior art are generally effective. However, the performance of such devices can be degraded by the dust particles separated from the surface during the sanding process. For example, during the sanding of a floor surface, these dust particles can accumulate and interfere with the sanding action by separating the abrasive pin heads from the surface of the floor. Accordingly, less of the surface is sanded during a given time, resulting in the need for repeated passes with the sanding machine. Such repeated sanding is undesirable because it can result in increased labor expenses. Further, because the repeated sanding causes increased wear on the abrasive pinheads, the useful life of the pins can be spent sanding a relatively small area. Accordingly, for a given area, the pins can require more frequent replacement, resulting in increased expenses for replacement parts.

Another disadvantage associated with the sanding heads of the prior art is the weight of the head itself. A disk-shaped head having a uniform thickness can be relatively heavy. Accordingly, some sanding machines can be difficult to maneuver and the installation or removal of the head itself can be troublesome, again resulting in increased labor costs.

Accordingly, there has existed a definite need for a lighter sanding head that can remove dust particles from the surface as it is sanded. The present invention satisfies these needs and provides further related advantages.

SUMMARY OF THE INVENTION

The present invention is embodied in a sanding head that can be relatively lightweight and can remove dust particles from the surface as it is sanded. More particularly, the present invention is embodied in a sanding head for a sanding machine used to sand a generally hard surface. The sanding machine rotates the sanding head so that a bottom surface of the sanding head spins above the surface to be sanded.

The sanding head comprises a rotatable disk having a bottom surface and an outer circumferential edge. The bottom surface has uniformly distributed topographical variations that extend radially inwardly from the outer edge of the disk. A plurality of uniformly distributed abraders project from the bottom surface of the disk to contact the surface to be sanded.

In another more detailed aspect of the invention, the topographical variations define large elongated ridges, small elongated ridges, and shallow channels. The large elongated ridges have a uniform height and a uniform curvature. The small elongated ridges have a uniform curvature and a height that is less than the height of the large elongated ridges. The shallow elongated channels are spaced between the elongated ridges and have a uniform depth and a uniform curvature.

One advantage of the topographical variations of the invention is associated with the strength of the disk, which is relatively greater than those of conventional sanding heads. Further, because the elongated ridges strengthen the disk, the overall thickness of the disk can be reduced for some applications. Accordingly, the sanding head can weigh less, thereby allowing easier operation of the sanding machine.

Another advantage associated with this invention is that the height and curvature of the large elongated ridges, the small elongated ridges, and the shallow elongated channels act to remove dust particles from the immediate area that is sanded. When the sanding head is rotated, dust particles are urged outwardly toward the edge of the disk, away from the abraders. Accordingly, the dust particles are less likely to come between the abraders and the surface to be sanded. Therefore, the sanding head is believed to allow the surface to be sanded more quickly, resulting in decreased labor costs. Further, because the abraders will not wear due to the repeated sanding of a dust-coated surface, it is believed that more surface can be sanded before their replacement is required. Therefore, the abraders can sand a greater amount of surface during their useful lives, resulting in decreased parts replacement costs.

It is to be understood that, within the proper scope and spirit of the invention, the bottom surface of the disk can have any type of uniformly distributed topographical variations having any height, depth, width, and curvature that act to expel dust from the immediate area to be sanded as the sanding head is rotated. Further, the word "disk" as used herein includes structures having any flat shape suitable for mounting on a rotary sanding machine, including flat circular shapes.

Other features and advantages of the present invention shall become apparent from the following description of the preferred embodiment, taken in conjunction with the accompanying drawings, which illustrate, by way of example, the principles of the invention.

BRIEF DESCRIPTION OF THE DRAWINGS

The following drawings illustrate the preferred embodiment of the invention. In such drawings:

FIG. 1 is a perspective view of a sanding head, including a disk and projecting abrading pins, attached to a floor sanding machine, showing the bottom surface of the disk;

FIG. 2 is a perspective view of an employee operating the floor sanding machine shown in FIG. 1;

FIG. 6 is a cross sectional view of the disk, taken in the direction of arrows 6—6 in FIG. 3.

DESCRIPTION OF THE PREFERRED EMBODIMENT

Figure 3:
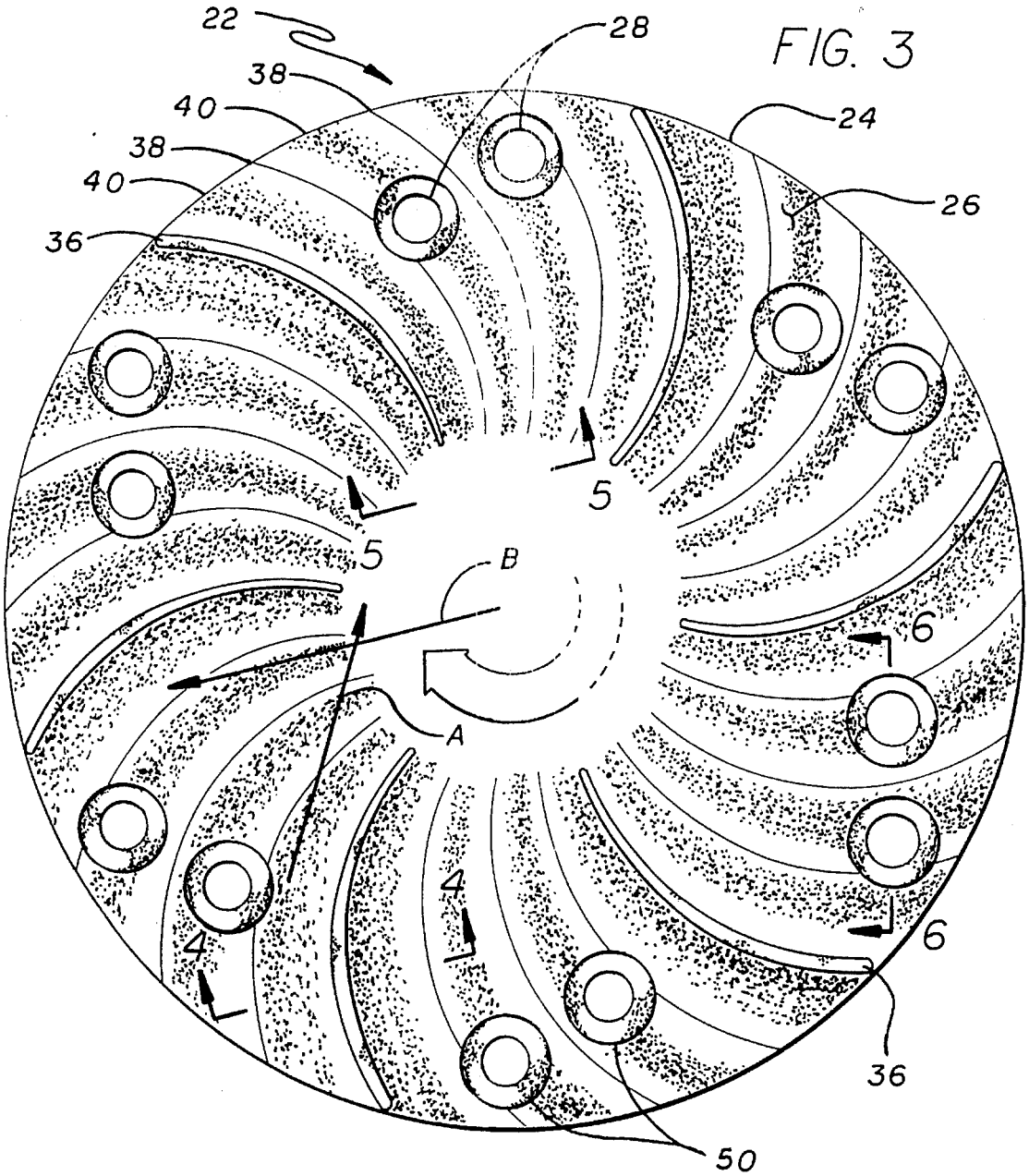
FIG. 3 is a bottom plan view of the disk shown in FIG. 1.

As shown in the exemplary drawings, and particularly FIGS. 1 and 2, the present invention is embodied in a sanding head 10 for a rotary floor sanding machine 12. The floor sanding machine has a control handle 14 and a housing 16 containing an electric motor (not shown). The sanding head is connected to the floor sanding machine and spins when the electric motor is activated. Such floor sanding machines are well known and are used to sand hard floor surfaces such as concrete or rock. The floor surface 18 is generally horizontal, but can be curved or otherwise irregular.

The sanding head 10 includes twelve pin-shaped abraders, referred to as abrading pins 20, mounted to a disk 22. The disk has an outer circumferential edge 24, a bottom surface 26, and twelve mounting holes 28. The bottom surface has topographical variations including ridges 30 that uniformly curve radially inwardly from the circumferential edge. The twelve mounting holes are generally cylindrical and are sized to accept the abrading pins, as discussed below. The disk preferably is about 15 inches in diameter and is made from aluminum. However, other materials of suitable strength may be used, including steel.

The abrading pins 20 project from the bottom surface 26 of the disk 22 and extend toward the floor surface 18. Each abrading pin has a longitudinal axis and an abrasive hexagonal head 32 for sanding the floor surface. The hexagonal cross section of each pin head is generally perpendicular to the longitudinal axis of its associated pin. The abrading pins are spring biased so that they can move along their longitudinal axis in response to uneven floor surfaces. The abrading pins are well known and are sold as pin HEX 1 PNG or 1 PNC, from the Pearl Abrasive Company, of Commerce, Calif. However, it is to be understood that the scope of the invention includes abraders of any shape or design, including pins, inserts, and any other device for sanding or abrading a floor surface.

As shown in FIG. 2, the floor sanding machine 12 is manually controlled by an employee 34 who grasps the control handle 14. When the floor sanding machine is placed in a position for use, the bottom surface 26 of the disk 22 is spaced above the floor surface 18 by the abrading pins 20, whose abrasive heads 32 contact the floor surface. It is to be understood that, within the proper scope and spirit of the invention, the sanding machine can be any type that rotates a sanding head above a generally hard surface.

Figure 4:
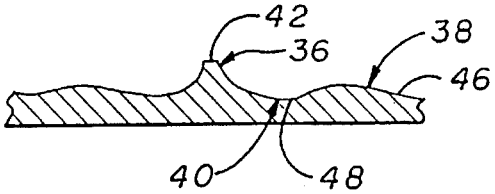
FIG. 4 is a cross sectional view of the disk, taken in the direction of arrows 4—4 in FIG. 3.
Figure 5:
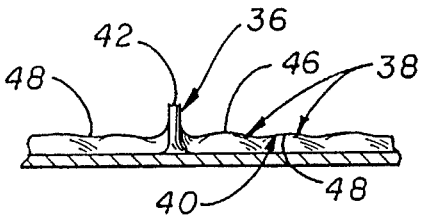
FIG. 5 is a cross sectional view of the disk, taken in the direction of arrows 5—5 in FIG. 3.

The topographical variations on the bottom surface 26 of the disk 22 now will be described in more detail. As shown in FIGS. 3, 4, and 5, the topographical variations include uniformly spaced, large elongated ridges 36, small elongated ridges 38, and shallow elongated channels 40 that all curve radially inwardly from the outer edge 24 of the disk. The radius of curvature of each large ridge is preferably uniform, as shown by the arrow A. Preferably, the radius of curvature represented by arrow A is about 4¼ inches. The center of curvature for each large ridge is located on a circle formed by a radius B from the center point of the bottom surface of the disk. Preferably, the circle represented by arrow B has a radius of about 5⅛ inches. Because this embodiment has six uniformly spaced large ridges, the centers of curvature for the ridges are spaced sixty degrees apart.

The curvature of the small ridges 38 and the shallow channels 40 is preferably the same as that of the large ridges 36. Three small ridges are uniformly spaced between each pair of large ridges. Accordingly, because the large ridges are separated by sixty degrees, the centers of curvature for the small ridges are spaced at fifteen degree increments on the circle represented by arrow B. The shallow channels are located between each pair of small ridges and between each large ridge and its adjacent small ridges. The shading on the top portion of FIG. 3 is intended to show the small ridges and shallow channels. Only a portion of the FIG. 3 is shaded, but the ridges and shallow channels 36 extend around the rest of the disk 22.

Each large ridge 36 projects from the bottom surface 26 of the disk 22 and has a blunt end surface 42. Note that the disk also includes a top surface 44. The height of the large ridges is uniform from the edge 24 of the disk toward the center of the disk. When the sanding head 10 is affixed to the floor sanding machine 12, the blunt end surfaces of each large ridge are spaced above the floor 18 to be sanded.

The small ridges 38 also project from the bottom surface 26 of the disk 22, but have curved end surfaces 46. The height of the small ridges decreases slightly from the edge 24 of the disk towards the center of the disk. Preferably, the height of each small ridge decreases by about 1/16 inch toward the center of the disk. At the outer edge of the disk, the height of the small ridges is also about 5/16 inch less than the height of the large ridges 36. Because the height of the small ridges decreases, their height toward the center of the disk is about ⅜ inch less than the height of the large ridges.

The bottom 48 of the shallow channels 40 is curved as well. The disk 22 preferably has a uniform thickness of about ⅜ inch along the bottoms of each shallow channel. The mounting holes 28 are generally cylindrical and define an inner passage between the top 44 and bottom 26 surfaces of the disk. The inside diameter of each mounting hole is sufficient to accept one abrading pin 20. A counterbore 50 on the bottom surface of the disk provides a flat surface to support each abrading pin. The mounting holes are uniformly distributed around the disk at alternating radiuses of about 5¾ and 6½ inches from the center of the disk. The mounting holes located at the 6½-inch radius are preferably spaced at sixty-degree increments. The mounting holes located at the 5¾-inch radius are spaced fifteen degrees counterclockwise from each of the holes located at the 6½-inch radius.

With reference to FIGS. 1 and 2, the use of the sanding head 10 will now be described. According to well known methods, the sanding head, comprising the disk 22 and the abrading pins 20, is attached to the floor sanding machine 12 so that the abrading pins rest on the floor surface 18. It should be understood that the present invention is not limited to any particular method or structure for the attachment of the sanding head to the floor sanding machine. After the sanding head is attached, the employee 34 positions the floor sanding machine above the surface to be sanded. The employee grasps the control handle 14 and activates the machine, causing the sanding head to rotate. The abrasive pinheads rotate and separate dust particles from the floor surface. The employee can manually change the position of the floor sanding machine when each portion of floor surface has been adequately sanded.

One advantage of the topographical variations of this embodiment of the invention is associated with the strength of the disk 22, which is relatively greater than that of conventional sanding heads having a uniform thickness. The ridges 36 and 38 strengthen the disk so that the overall thickness of the disk can be reduced. Accordingly, the sanding head can weigh less, thereby allowing easier operation of sanding machines for other applications.

Another advantage associated with this embodiment is that the height and curvature of the large ridges 36, the small ridges 38, and the shallow channels 40 act to remove dust particles from the immediate area that is sanded. When the sanding head 10 is rotated, dust particles are urged outwardly toward the edge of the disk, away from the abrading pins 20. Accordingly, the dust particles are less likely to come between the abrasive heads 32 of the abrading pins and the floor surface 18. Therefore, the sanding head is believed to allow the floor surface to be sanded more quickly, resulting in decreased labor costs. Further, because the abrasive pinheads will not wear due to the repeated sanding of a dust-coated floor surface, it is believed that more floor surface can be sanded before their replacement is required. Therefore, the abrading pins can sand a greater amount of floor surface during their useful lives, resulting in decreased parts replacement costs.

It is to be understood that, within the proper scope and spirit of the invention, the bottom surface 26 of the disk 22 can have any type of uniformly distributed topographical variations having any height, depth, width, and curvature that act to expel dust from the immediate area to be sanded as the sanding head 10 is rotated.

While a particular form of the invention has been illustrated and described, it will be apparent that various modifications can be made without departing from the spirit and scope of the invention. Accordingly, it is not intended that the invention be limited, except as by the appended claims.

What is claimed is:

1. A sanding head for a sanding machine, the sanding machine being of the type used to sand a generally hard surface, the sanding machine rotating the sanding head so that a bottom surface of the sanding head is spinning above the surface to be sanded, the sanding head comprising:

a rotatable disk having a bottom surface and an outer circumferential edge, the bottom surface having uniformly distributed topographical variations extending radially inwardly from the outer edge; and a plurality of uniformly distributed abraders projecting from the bottom surface of the disk to contact the surface to be sanded, wherein the abraders are pins having a longitudinal axis projecting perpendicularly from the bottom surface of the disk, each pin having an abrasive hexagonal head for contacting the surface to be sanded, the hexagonal cross-section of the abrasive head being oriented perpendicular to the longitudinal pin axis.

2. The sanding head as defined in claim 1, wherein the topographical variations define a plurality of elongated channels.

3. The sanding head as defined in claim 1, wherein the topographical variations define a plurality of elongated ridges.

4. The sanding head as defined in claim 1, wherein the topographical variations define elongated ridges having a uniform height and a uniform curvature.

5. A sanding head for a sanding machine, the sanding machine being of the type used to sand a generally hard surface, the sanding machine rotating the sanding head so that a bottom surface of the sanding head is spinning above the surface to be sanded, the sanding head comprising:

a rotatable disk having a top surface, a bottom surface, an outer circumferential edge, and a plurality of inner cylindrical surfaces, each inner surface defining a mounting hole between the top surface and the bottom surface, the bottom surface having uniformly distributed topographical variations defining large elongated ridges, small elongated ridges, and shallow elongated channels, the large elongated ridges having a uniform height and uniformly curving radially inwardly from the outer edge of the disk, the small elongated ridges uniformly curving radially inwardly from the outer edge and having a height less than that of the large elongated ridges, the height of each small elongated ridge gradually decreasing as it extends radially inwardly from the outer edge, the small elongated ridges spaced between the large elongated ridges at 15° intervals, the small elongated channels having a uniform depth and uniformly curving radially inwardly from the outer edge of the disk, the shallow elongated channels spaced between the ridges; and a plurality of abrading pins, each having a longitudinal axis and an abrasive hexagonal head for contacting the surface to be sanded, each pin projecting from one mounting hole such that its longitudinal axis is perpendicular to the bottom surface of the disk, the hexagonal cross section of each pin head perpendicular to the longitudinal axis of that pin.

6. The sanding head as defined in claim 1, wherein the topographical variations include a plurality of uniformly distributed elongated ridges and elongated channels.

7. A sanding head for a sanding machine, the sanding machine being of the type used to sand a generally hard surface, the sanding machine rotating the sanding head so that a bottom surface of the sanding head is spinning above the surface to be sanded, the sanding head comprising:

a rotatable disk having a bottom surface and an outer circumferential edge, the bottom surface having uniformly distributed topographical variations extending radially inwardly from the outer edge, the topographical variations defining large elongated ridges, small elongated ridges, and shallow elongated channels, the large elongated ridges having a uniform height and a uniform curvature; the small elongated ridges having a uniform curvature and a height less than the height of the large elongated ridges, and the shallow elongated channels having a uniform depth and a uniform curvature, and spaced between the elongated ridges; and a plurality of uniformly distributed abraders projecting from the bottom surface of the disk to contact the surface to be sanded.

8. The sanding head as defined in claim 7, wherein the difference between the height of the large elongated ridges and the small elongated ridges is at least 5/16 of an inch.

9. The sanding head as defined in claim 7, wherein the small elongated ridges are spaced between the large elongated ridges at 15° intervals.

10. A sanding head for a sanding machine, the sanding machine being of the type used to sand a generally hard surface, the sanding machine rotating the sanding head so that a bottom surface of the sanding head is spinning above the surface to be sanded, the sanding head comprising:

a rotatable disk having a top surface, a bottom surface, an outer circumferential edge, and a plurality of inner cylindrical surfaces, each inner surface defining a mounting hole between the top surface and the bottom surface, the bottom surface having uniformly distributed topographical variations extending radially inwardly from the outer edge; and a plurality of uniformly distributed abraders, each mounted in one of the mounting holes and projecting from the bottom surface of the disk to contact the surface to be sanded.

11. The sanding head as defined in claim 10, wherein the topographical variations define a plurality of elongated channels.

12. The sanding head as defined in claim 10, wherein the topographical variations define a plurality of elongated ridges.

13. The sanding head as defined in claim 10, wherein the topographical variations define elongated ridges having a uniform height and a uniform curvature.

14. The sanding head as defined in claim 10, wherein the abraders are pins having a longitudinal axis projecting perpendicularly from the bottom surface of the disk, each pin having an abrasive hexagonal head for contacting the surface to be sanded, the hexagonal cross section of the abrasive head being oriented perpendicular to the longitudinal pin axis.

15. The sanding head as defined in claim 10, wherein:

the topographical variations define large elongated ridges, small elongated ridges, and shallow elongated channels;

the large elongated ridges have a uniform height and a uniform curvature;

the small elongated ridges have a uniform curvature and a uniform height less than the height of the large elongated ridges; and the shallow elongated channels have a uniform depth and a uniform curvature and are spaced between the elongated ridges.

16. The sanding head as defined in claim 15, wherein the small elongated ridges are spaced between the large elongated ridges at 15° intervals.

17. The sanding head as defined in claim 15, wherein the difference between the height of the large elongated ridges and the small elongated ridges is at least 5/16 of an inch.

18. The sanding head as defined in claim 10, wherein the topographical variations include a plurality of uniformly distributed elongated ridges and elongated grooves.

* * * * *